US006131760A

United States Patent [19]

Huang

[11] Patent Number: 6,131,760

[45] Date of Patent: Oct. 17, 2000

[54] STORAGE BOX

[76] Inventor: Cheng-Ho Huang, 2Fl., No. 4, Lane 71, Chung-Cheng N. Road, Taipei Hsien, Taiwan

[21] Appl. No.: 09/497,116

[22] Filed: Feb. 3, 2000

[51] Int. Cl.[7] ..... B65D 21/02

[52] U.S. Cl. ..... 220/526; 220/4.22; 220/326

[58] Field of Search ..... 220/826, 4.22, 220/326

[56] References Cited

U.S. PATENT DOCUMENTS

| | | | |
|---|---|---|---|
| 3,487,972 | 1/1970 | Swett | 220/526 |
| 5,094,355 | 3/1992 | Clark et al. | 220/526 |
| 5,277,329 | 1/1994 | Pomroy et al. | 220/526 |
| 5,344,024 | 9/1994 | Cohu | 220/526 |
| 5,588,561 | 12/1996 | Ness | 220/526 |
| 5,730,313 | 3/1998 | Hayes et al. | 220/526 |

*Primary Examiner*—Joseph M. Moy
*Attorney, Agent, or Firm*—Bacon & Thomas, PLLC

[57] ABSTRACT

A storage box having an upper cover, a lower cover pivotally connected with the upper cover and a resilient sealing ring securely received in an edge of the lower cover so as that when the upper cover and the lower cover are engaged with each other, a water-tight engagement is achieved. Furthermore, due to an arcuate front face formed on the upper cover, the engaging force of the upper cover to the lower cover will be enhanced due to the stress-deformation effect.

1 Claim, 10 Drawing Sheets

STORAGE BOX

CROSS REFERENCE

Not applicable

DESCRIPTION OF RELATED ART

1. Field of the Invention

The invention relates to a storage box and, more particularly to a storage box using an upper cover with arcuate side edges to mate with a lower cover so as to form a M-shaped force pattern when the upper cover engages with the lower cover. With such a construction, beside the existed pivots and the snap plate, due to the stress-deformation effect, when the upper cover engages the lower cover, the expansion of the side edges of the upper cover will provide extra force to enhance the contact with the lower cover.

2. Prior Art Description

Conventional storage boxes normally have two kinds of material for making the upper cover, one is the hard material and the other is the soft material. If the manufacturer chooses to use the hard material, there is always a clearance in the mating between the upper cover and the lower cover, such that the sealing effect therebetween is not so good as expected. However, should the manufacturer chooses to make the upper cover with a kind of soft material, not only the overall appearance is not appealing, but also the sealing effect between the compartments divided in the lower cover is not satisfactory due to the flexibility of the material.

Furthermore, due to the existence of workpiece clearance, the mating effect between the two covers is not good. Should the length of the box be longer, the sealing between the two covers is worse. That is because the contact force between the upper cover and the lower cover is not able to be transmitted to the L-shaped corners to fully accomplish the requirement.

Still further, the conventional storage box normally has pivots mounted for providing the pivoting function to the upper cover in respect to the lower cover. The locations where the pivots are mounted have the maximum contact force, but other places have less contact force. Therefore, the distribution of contact force is not able to evenly divided to all parts of the contact places between the upper cover and the lower cover.

In order to solve the aforementioned problems, the invention provides an improved storage box to mitigate and obviate the unsatisfactory situation.

SUMMARY OF THE INVENTION

The primary objective of the invention is to provide an improved storage box having an outstanding sealing feature for storing delicate objects therein (such as contact lenses, sensitive solution . . . etc.). To achieve the aforementioned objective, the box of the invention provides an upper cover and a lower cover pivotally connected with the upper cover. The upper cover has an aucuate upper face and a saddle-like protrusion formed on a first edge thereof. The lower cover has a trough defined in a second edge corresponding to the first edge, a resilient sealing ring received in the trough. With the corresponding relationship between the upper cover and the lower cover, the upper cover is able to sealingly engaged with the lower cover.

Beside the arcuate upper face, the upper cover further has a divider formed on a lower face thereof. The lower cover is able to have partitions provided therein to correspond to the divider, such that even the overall length of the box is so long that there is no way to provide sufficient engaging force between the upper and the lower covers when using the conventional technique, the storage box in accordance with the present invention is still able to provide sufficient engaging force between the upper cover and the lower cover. The sealing effect between the upper and the lower covers is even much better than the boxes existed in the market.

Other objective of the invention will be clear after the detailed description with the reference to the accompanying drawings.

BRIEF DESCRIPTION OF THE INVENTION

The present invention will be better understood with the description to the following drawings, wherein.

DETAILED DESCRIPTION OF THE PREFERRED EMBODIMENT

Figure 1:
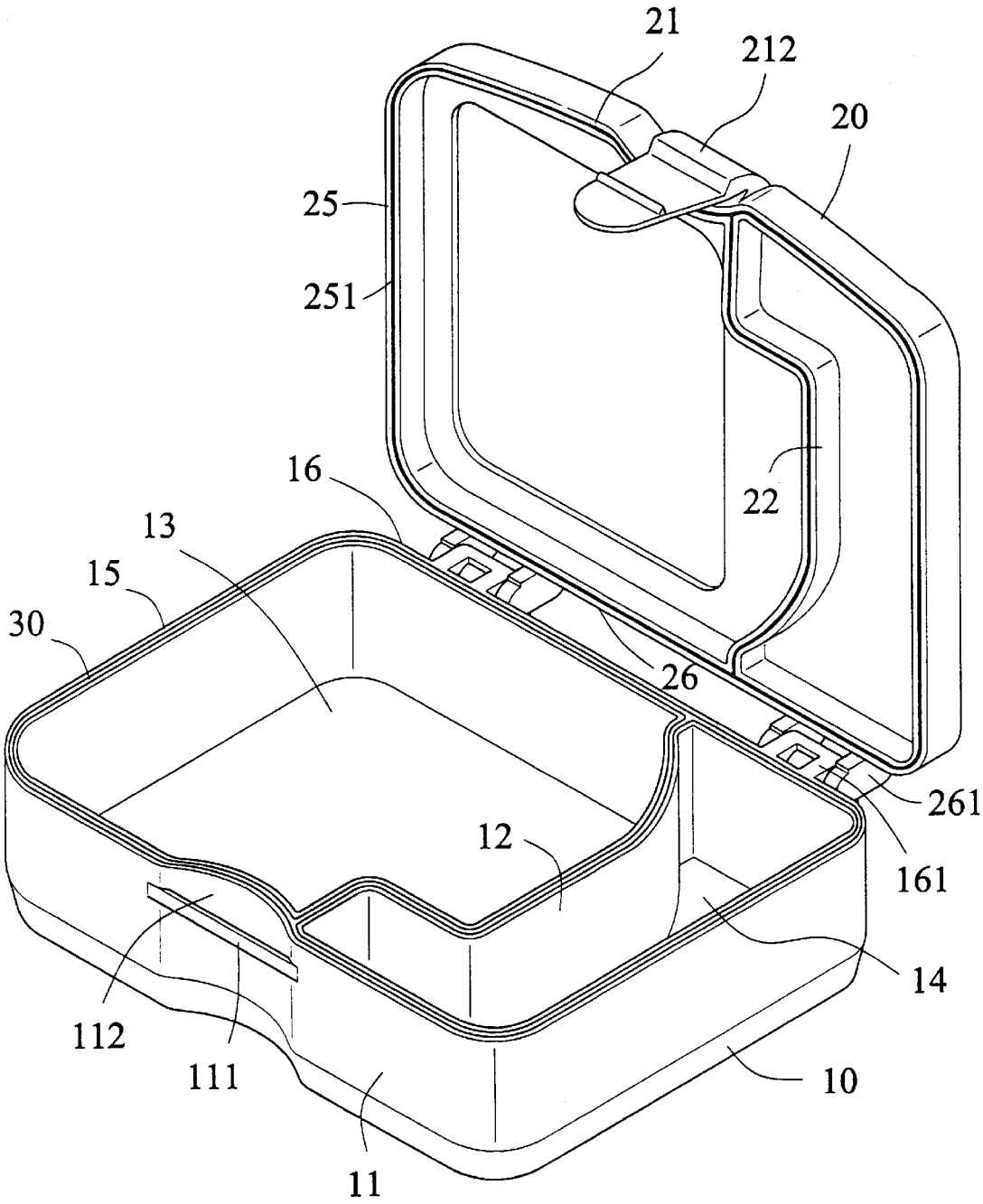
FIG. 1 is a perspective view of a storage box constructed in accordance with the present invention.
Figure 2:
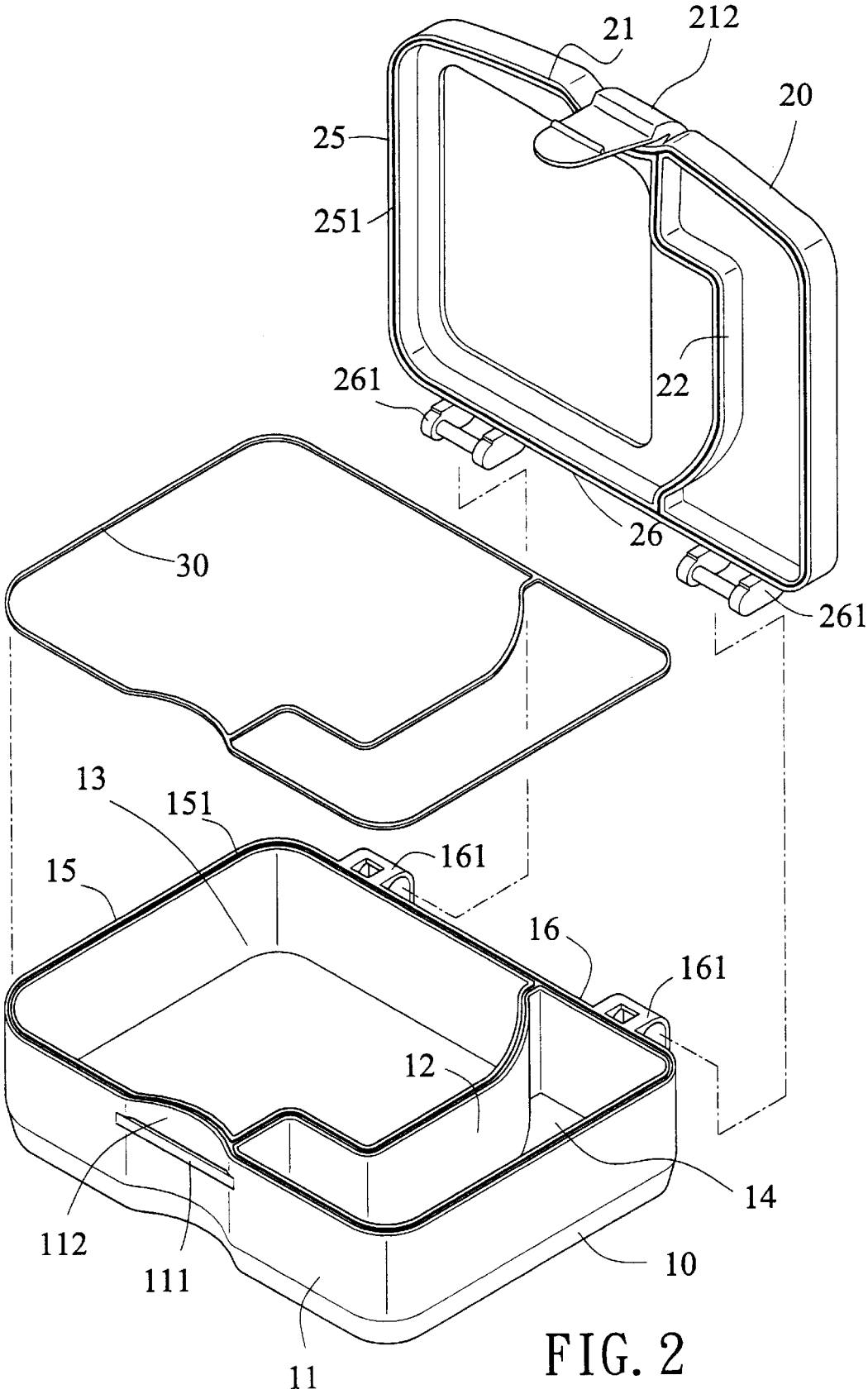
FIG. 2 is an exploded perspective view showing all the parts and detailed structure of the box shown in FIG. 1.
Figure 3:
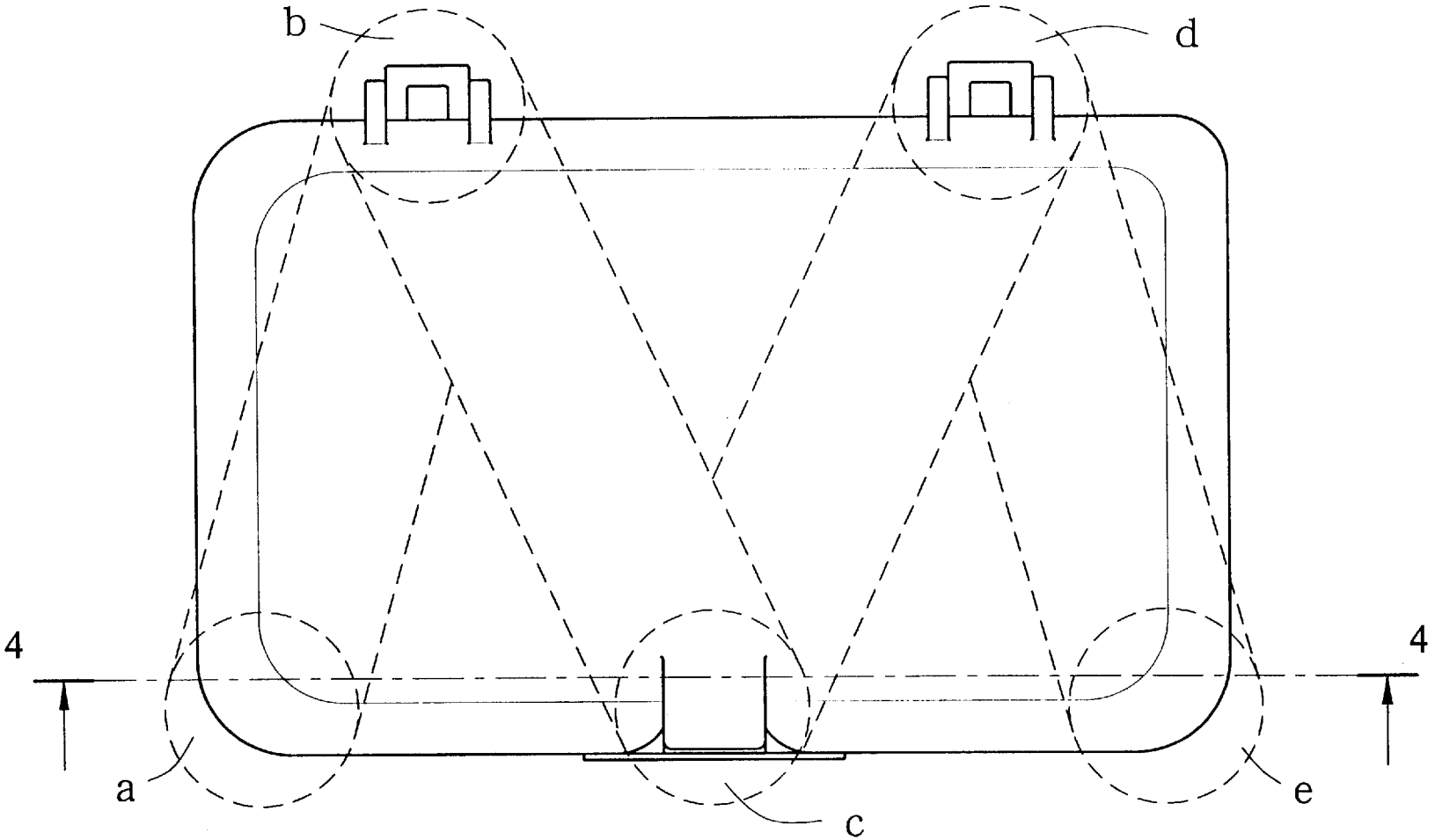
FIG. 3 is a top view showing schematically the force applied between an upper cover and a lower cover of the box of FIG. 1.
Figure 4:
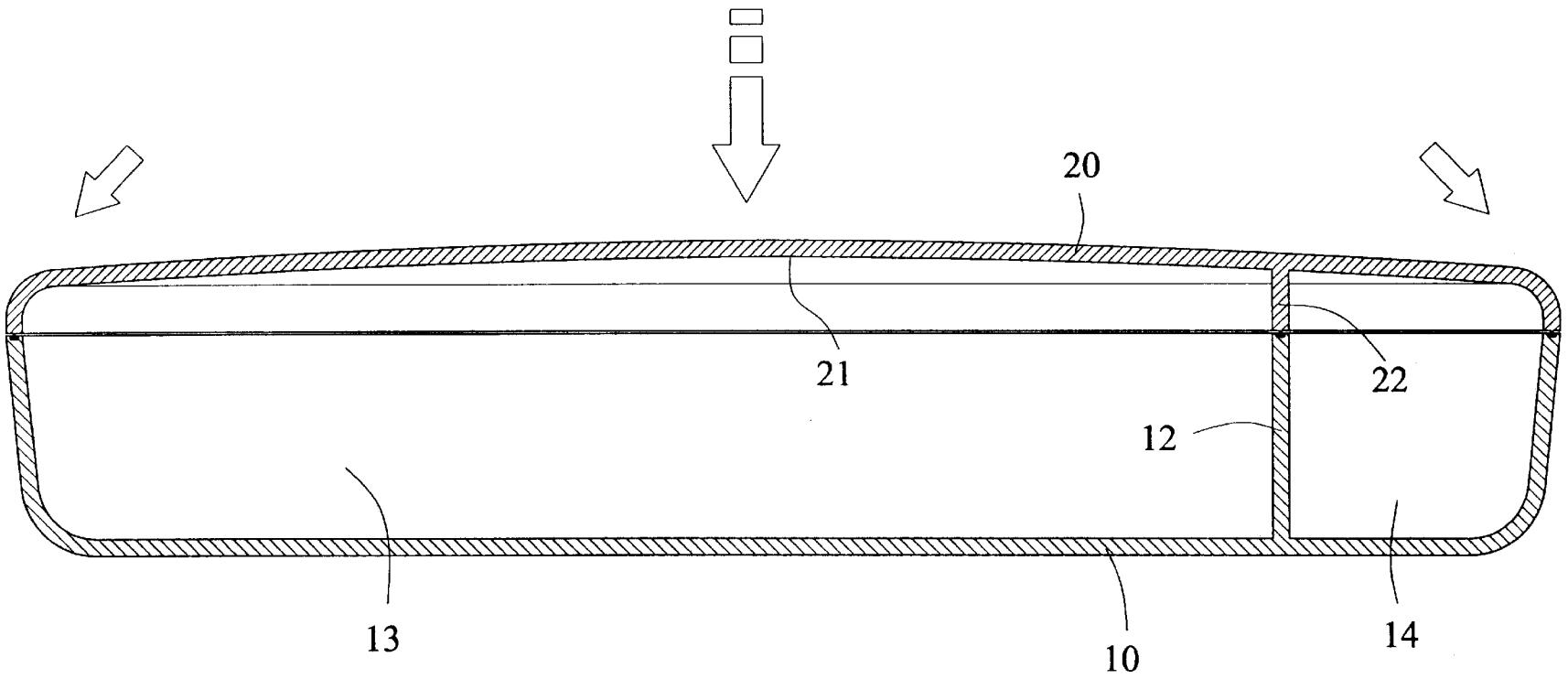
FIG. 4 is a side view in cross section by taking the line 4—4 of FIG. 3.

With reference to FIGS. 1–4, the storage box constructed in accordance with the present invention comprises a lower cover (10), an upper cover (20) pivotally connected with the lower cover (10) and a resilient sealing ring (30) securely connected therebetween.

The upper cover (20) has an arcuate front face (21) with a snap plate (212), a saddle-like protrusion (251) provided on a first edge (25) thereof, a divider (22) formed on a lower face of the upper cover (20) and a rear face (26) provided with at least a pivot (261).

The lower cove (10) has a front face (11) with a stop (111) formed to correspond to the snap plate (212) and a space (112) defined to allow the movement of the snap plate (212) due to the flexibility thereof, a partition (12) formed inside the lower cover (10) to divide the lower cover (10) into a first space (13) and a second space (14), a second edge (15) formed to correspond to the first edge (25) of the upper cover (20) and defining therein a trough (151) and at least a pivot seat (161) formed on a rear face (16) opposite to the front face (11).

The resilient sealing ring (30) is made of a resilient material and is so configured to be received in the trough (151) of the second edge (15) of the lower cover (15). When the upper cover (20) and the lower cover (10) are assembled after the resilient sealing ring (30) is securely received in the trough (151), the upper cover (20) is able to pivot with respect to the lower cover (10) by means of the at least one pivot (261) and the pivot seat (161) (two are provided in the preferred embodiment). After the upper and the lower cover (10) are engaged together, beside the force applied by the snap plate (212) and the pivot (261) (points b, c, and d), because the arcuate front face (21) of the upper cover (20), the engaging force can also apply to the corners (points a, e), which forms a M-shaped force pattern to enhance the engagement between the upper cover and the lower cover (20,10). Furthermore, because of the provision of the saddle-like protrusion (251) formed on a first edge (25) of the upper cover (20). and the trough (151) defined in the second edge (15) corresponding to the first edge (25), the engagement between the upper and the lower cover (20,10) will be a water-tight engagement.

Figure 5:
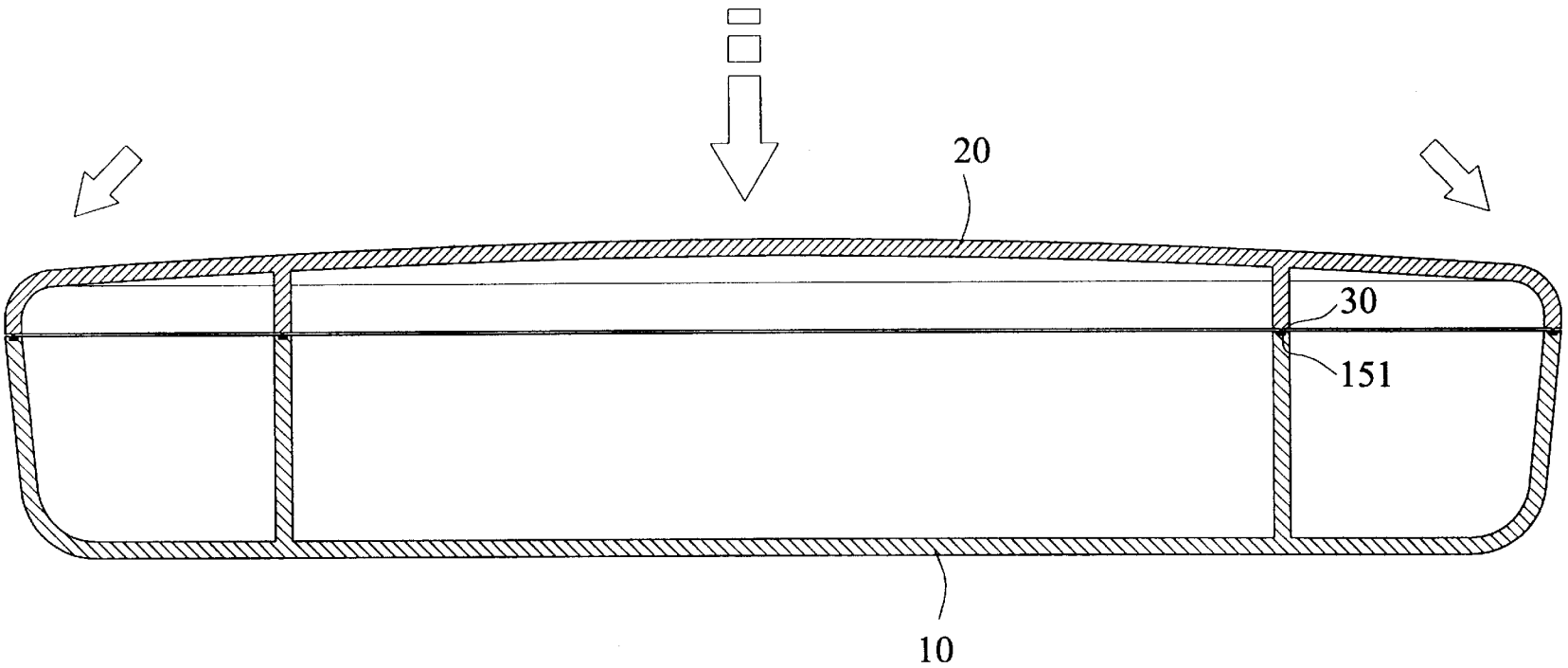
FIG. 5 is a side view in cross section showing an alternative embodiment of the invention.

FIG. 5 shows still an alternative embodiment of the invention, wherein the work clearance is able to compensate by the resilient sealing ring (30) and the engagement between the saddle-like protrusion and the trough (151) and thus the engagement between the upper and lower covers (10,20) will be a water-tight engagement. With such an arrangement, the user is able to use the box of the invention to store sensitive solutions or some other delicate objects such as contact lenses in order to avoid contamination by pollutant.

Figure 6:
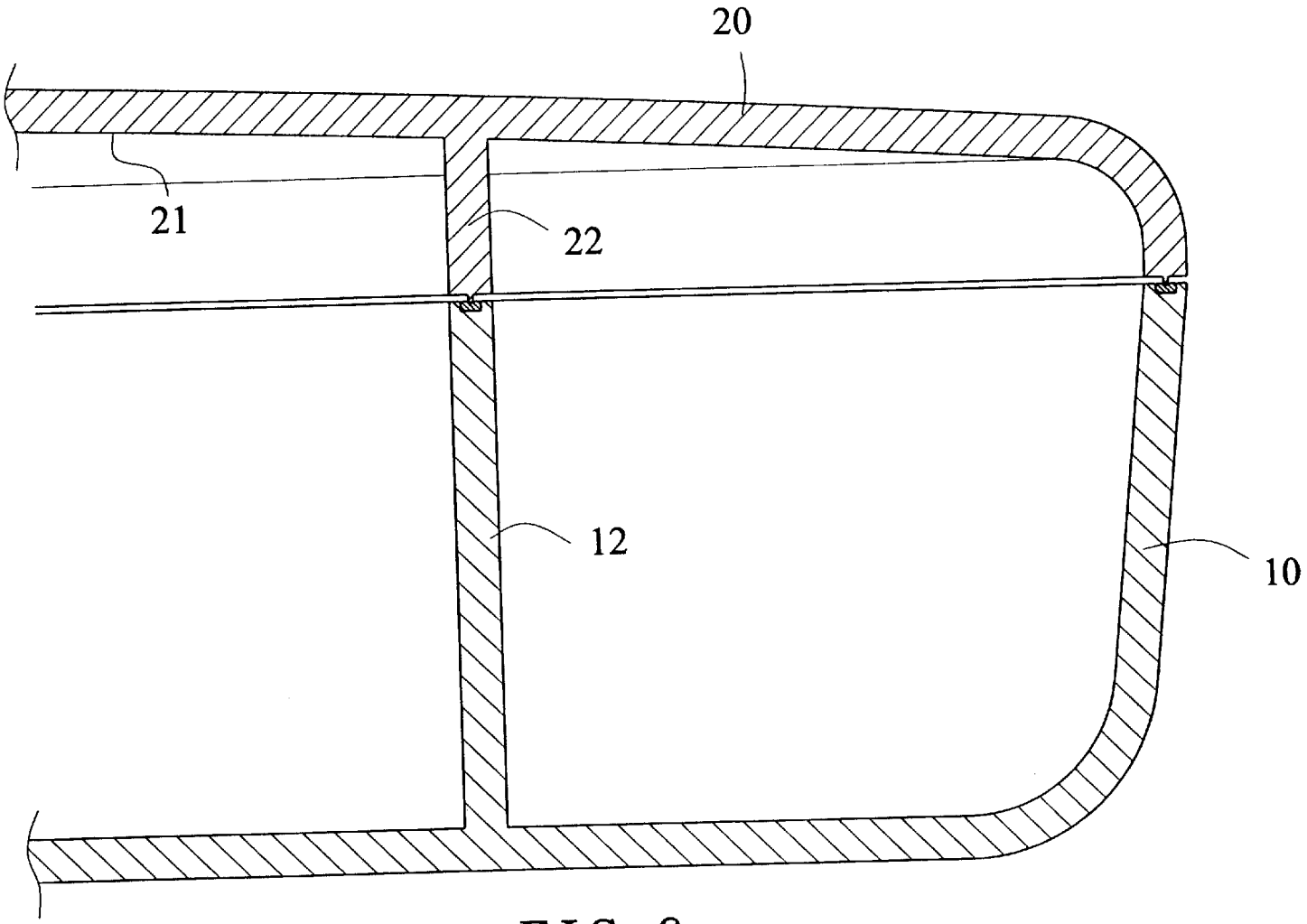
FIG. 6 is an enlarged side view in cross section showing the force pattern applied between the upper and the lower covers due to the arcuate upper face of the upper cover.
Figure 7A:
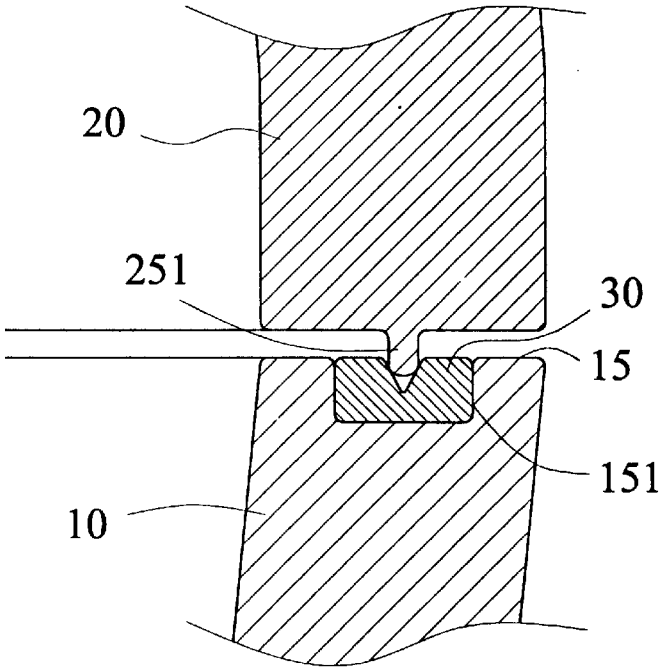
FIG. 7A is an enlarged schematic view showing the engagement between the upper cover and the lower cover.
Figure 7B:
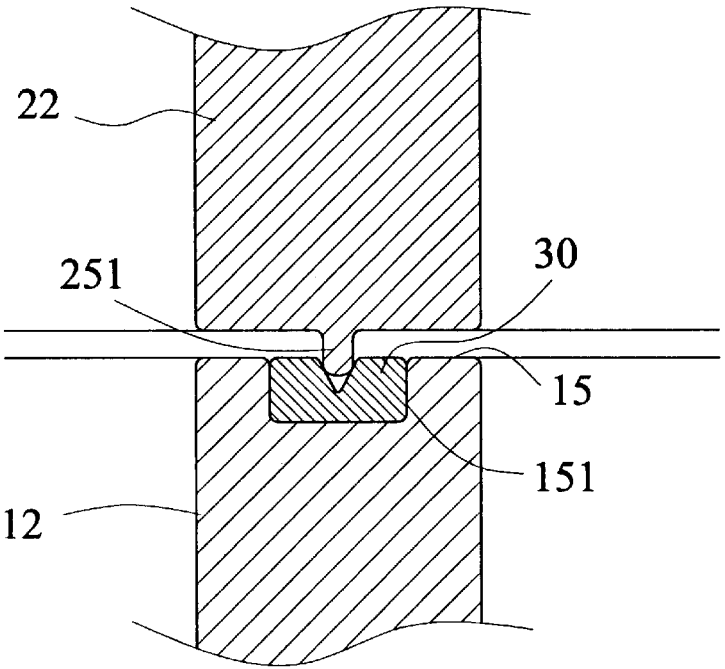
FIG. 7B is an enlarged schematic view showing the engagement between a divider and an upper face of a partition in the lower cover.

With reference to FIG. 6, FIG. 7A and FIG. 7B, it is to be noted that due to the arcuate front face (21) of the upper cover (20), there is always a downward component applied to the divider (22) and the first edge (25), so that even the overall length of the upper cover (20) is too long to provide sufficient engagement force to the lower cover (10) when using the conventional technique, the present invention is still able to provide sufficient engagement force to the lower cover (10) to achieve water-tight engagement.

Figure 8:
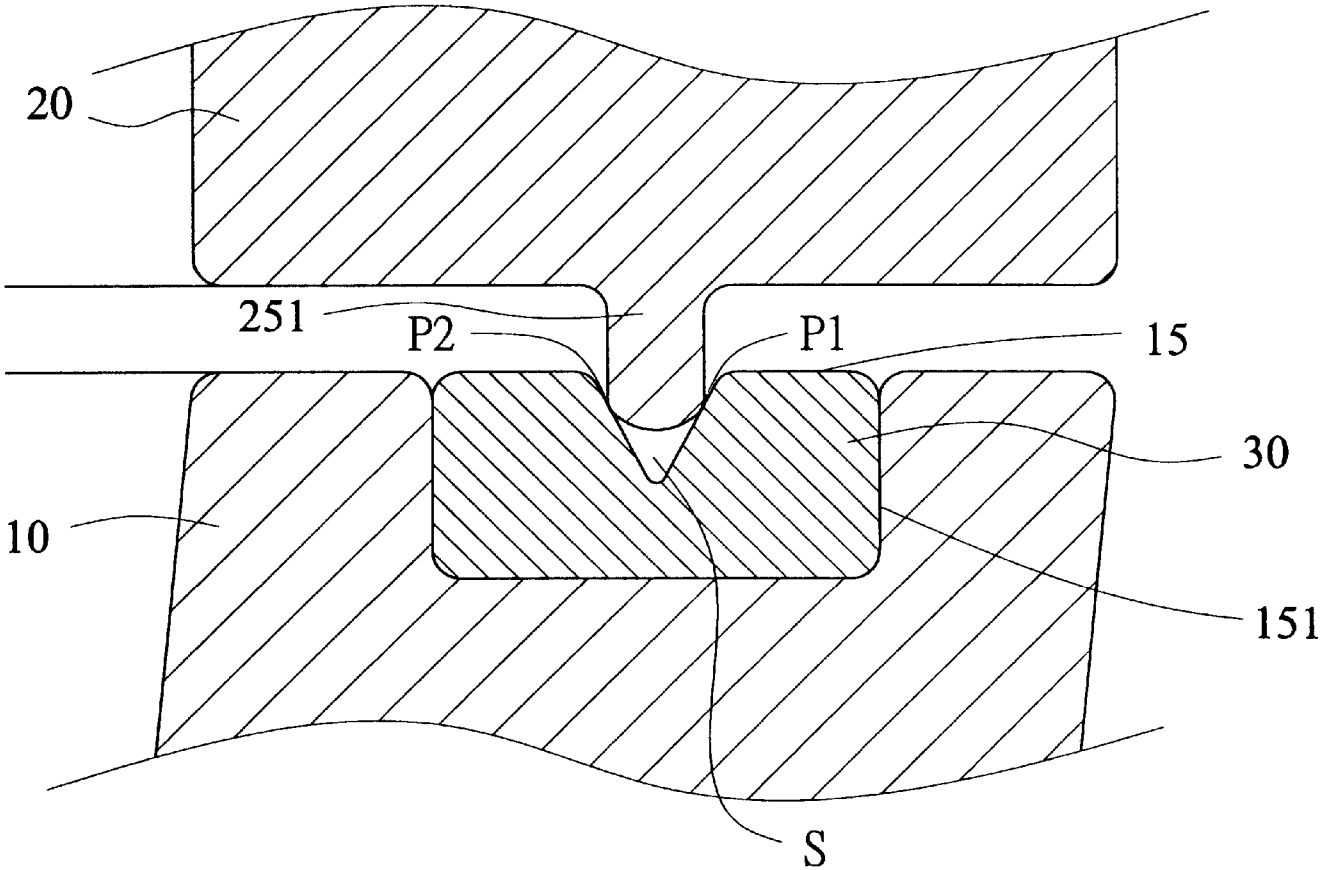
FIG. 8 is an enlarged schematic view showing the engagement between the upper and the lower cover by means of a resilient sealing ring.

Referring to FIG. 8, when the saddle-like protrusion (251) is engaging with the trough (151), due to a V-shaped groove S defined in the resilient sealing ring (30), there will be two engaging faces (P1,P2) between the protrusion (251) and the ring (30), which provides a double guaranty of water proof.

Figure 9:
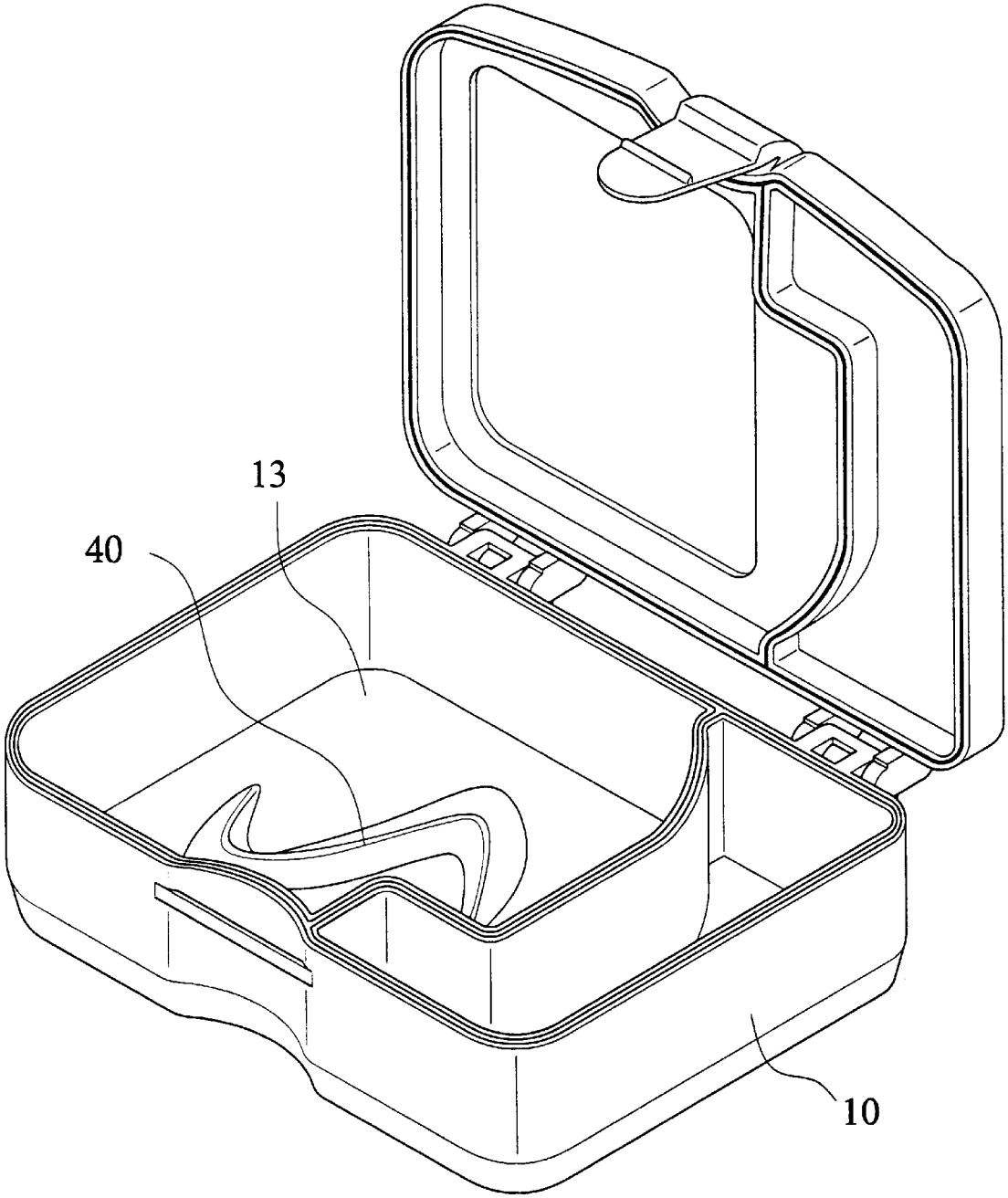
FIG. 9 is a perspective view showing still another preferred embodiment of the invention.

FIG. 9 shows another preferred embodiment of the invention, wherein a seat (40) is able to be formed in the first space (13) in the lower cover (10) so as to receiving or providing support to an object.

Figure 10:
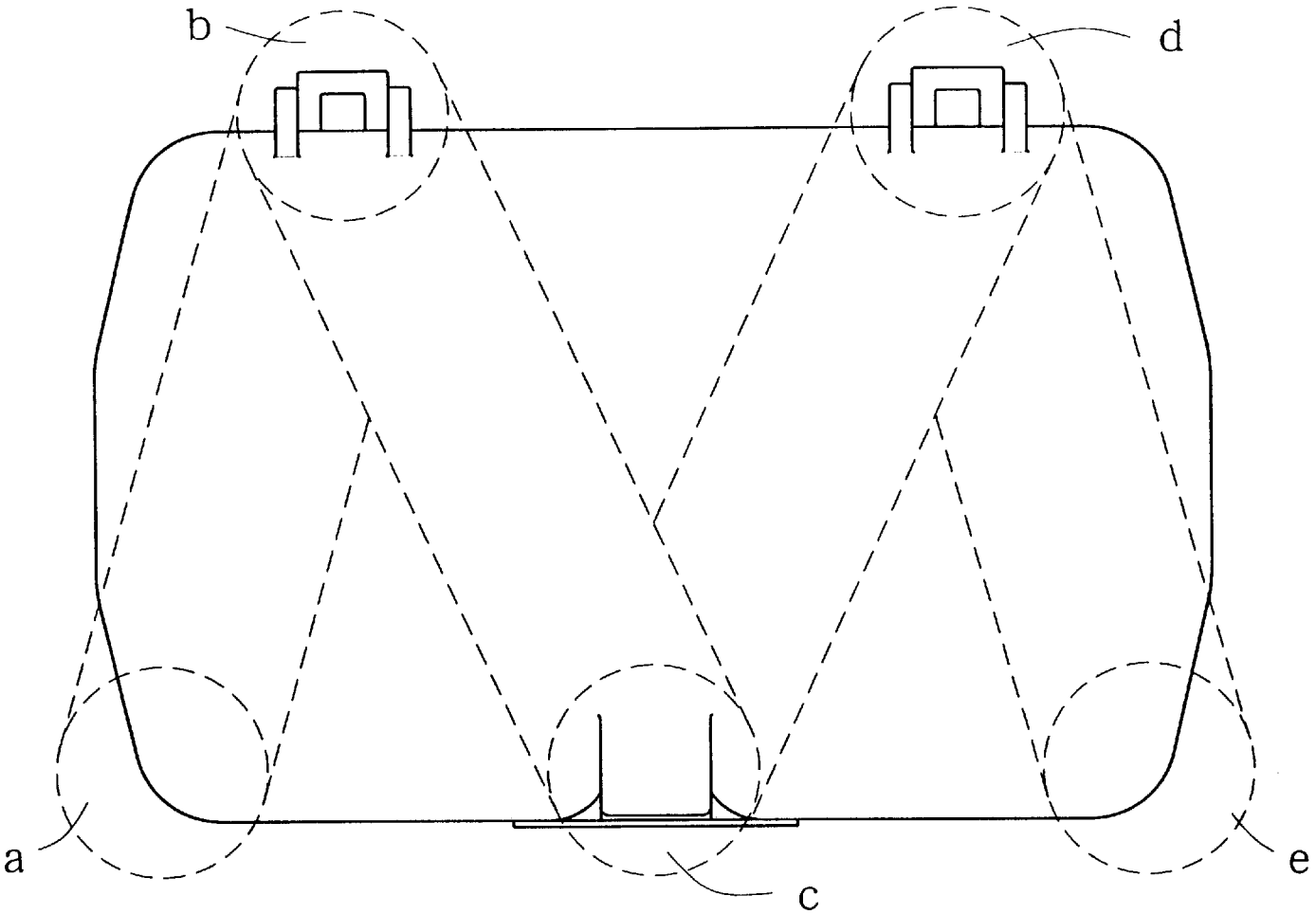
FIG. 10 is a top plan view showing schematically the force pattern applied between the upper and the lower covers of still another preferred embodiment of the invention.

The technique of the invention is able to be applied to an irregular box as shown in FIG. 10 and still able to achieve the aforementioned objectives.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A storage box comprises a lower cover (10), an upper cover (20) pivotally connected with the lower cover (10) and a resilient sealing ring (30) securely connected therebetween, wherein the improvements comprises:

the upper cover (20) has an arcuate front face (21) with a snap plate (212), a saddle-like protrusion (251) provided on a first edge (25) thereof, a divider (22) formed on a lower face of the upper cover (20) and a rear face (26) provided with at least a pivot (261);

the lower cover (10) has a front face (11) with a stop (111) formed to correspond to the snap plate (212) and a space (112) defined to allow the movement of the snap plate (212), a partition (12) formed inside the lower cover (10) to correspond to the divider (22) to divide the lower cover (10) into a first space (13) and a second space (14), a second edge (15) formed to correspond to the first edge (25) of the upper cover (20) and defining therein a trough (151) and at least a pivot seat (161) formed on a rear face (16) opposite to the front face (11) to pivotally receive the pivot (261);

the resilient sealing ring (30) is made of a resilient material and is so configured to be received in the trough (151) of the second edge (15) of the lower cover (15); whereby after the upper and the lower cover (10) are engaged together, beside the force applied by the snap plate (212) and the pivot (261), because the arcuate front face (21) of the upper cover (20), the engaging force can also be applied to the corners of the box, which forms a M-shaped force pattern to enhance the engagement between the upper cover and the lower cover (20,10).

* * * * *